US007704196B2

(12) United States Patent
Lien et al.

(10) Patent No.: US 7,704,196 B2
(45) **Date of Patent: *Apr. 27, 2010**

(54) WEIGHT PLATE

(75) Inventors: Louis Lien, Bellaire, TX (US); Annie Wu, Houston, TX (US)

(73) Assignee: USA Sports, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/929,329

(22) Filed: Oct. 30, 2007

(65) Prior Publication Data

US 2008/0113851 A1 May 15, 2008

Related U.S. Application Data

(63) Continuation of application No. 11/422,650, filed on Jun. 7, 2006, now Pat. No. 7,300,389, which is a continuation of application No. 10/862,294, filed on Jun. 7, 2004, now abandoned, which is a continuation of application No. 09/758,770, filed on Jan. 11, 2001, now Pat. No. 6,746,380.

(51) Int. Cl.
*A63B 21/072* (2006.01)
*A63B 21/06* (2006.01)

(52) U.S. Cl. ..... 482/106; 482/93

(58) Field of Classification Search ..... 482/93, 482/106–109; D21/679–684
See application file for complete search history.

(56) References Cited

U.S. PATENT DOCUMENTS

| | | | |
|---|---|---|---|
| 1,047,212 | A | 12/1912 | Hamilton |
| 2,244,351 | A | 6/1941 | Venables |
| 2,447,218 | A | 8/1948 | Trzesniewski |
| 2,676,802 | A | 4/1954 | O'Brien |
| 2,796,269 | A | 6/1957 | Watson |
| D194,042 | S | 11/1962 | Guthormsen |
| 3,171,652 | A | 3/1965 | Newman |
| 3,226,117 | A | 12/1965 | Walklet |
| 3,482,835 | A | 12/1969 | Dean |
| D216,517 | S | 1/1970 | Dorn |
| 3,572,702 | A | 3/1971 | Dorn |
| 3,771,785 | A | 11/1973 | Speyer |
| 3,796,431 | A | 3/1974 | Sinyard |
| 3,913,908 | A | 10/1975 | Speyer |
| 3,971,555 | A | 7/1976 | Mahnke |
| 4,079,932 | A | 3/1978 | Schuetz |
| 4,231,569 | A | 11/1980 | Rae |
| 4,311,306 | A | 1/1982 | Solloway |
| 4,369,968 | A | 1/1983 | Price |

(Continued)

*Primary Examiner*—Fenn C Mathew
(74) *Attorney, Agent, or Firm*—Wong, Cabello, Lutsch, Rutherford & Brucculeri, LLP

(57) ABSTRACT

An improved weight plate includes a planar body having a central opening for receiving a barbell or dumbbell bar therethrough. The weight plate includes oppositely facing flange members extending partially about the perimeter of the weight plate. The opposed ends of the flange members are spaced from each other and define a gap therebetween. The flange members extend perpendicularly from both sides of the weight plate planar body about the perimeter thereof. The weight plate includes at least one opening formed adjacent the perimeter of the weight plate. The opening is adapted to receive one or more fingers of an average human hand for securely grasping and lifting the weight plate. Adjacent weight plates mounted on a barbell bar are adapted for interlocking engagement.

27 Claims, 4 Drawing Sheets

U.S. PATENT DOCUMENTS

| | | | | |
|---|---|---|---|---|
| 4,373,717 | A | | 2/1983 | Lambert, Jr. |
| D274,283 | S | | 6/1984 | Wright |
| 4,455,020 | A | | 6/1984 | Schnell |
| 4,482,151 | A | | 11/1984 | Zwilling |
| D278,358 | S | | 4/1985 | Zwilling |
| 4,515,364 | A | | 5/1985 | Rotella |
| 4,625,959 | A | | 12/1986 | Schleffendorf |
| 4,673,179 | A | | 6/1987 | Pengler |
| 4,756,526 | A | | 7/1988 | Broussard |
| 4,817,944 | A | | 4/1989 | Anderson et al. |
| 4,828,256 | A | | 5/1989 | Lee |
| 4,854,575 | A | | 8/1989 | Wilson et al. |
| 4,880,229 | A | | 11/1989 | Brousard |
| D309,763 | S | | 8/1990 | Solloway |
| D355,007 | S | * | 1/1995 | Rojas et al. ..... D21/681 |
| 5,853,355 | A | * | 12/1998 | Standish ..... 482/106 |
| D424,639 | S | * | 5/2000 | Rojas et al. ..... D21/680 |
| D448,055 | S | * | 9/2001 | Lien et al. ..... D21/681 |
| D451,160 | S | * | 11/2001 | Rojas et al. ..... D21/680 |
| 6,319,176 | B1 | * | 11/2001 | Landfair ..... 482/93 |
| 6,328,678 | B1 | * | 12/2001 | Romero ..... 482/106 |
| D454,167 | S | * | 3/2002 | Lincir ..... D21/680 |
| 6,746,380 | B2 | * | 6/2004 | Lien et al. ..... 482/106 |
| 7,300,389 | B2 | * | 11/2007 | Lien et al. ..... 482/106 |

* cited by examiner

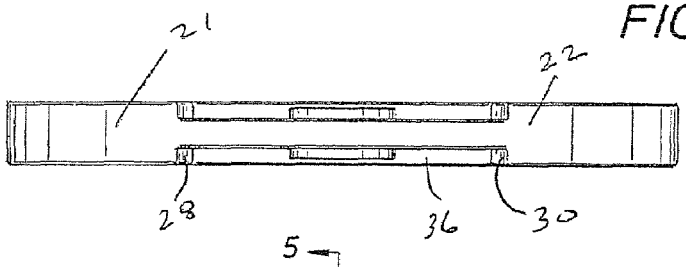
FIG. 3
FIG. 2
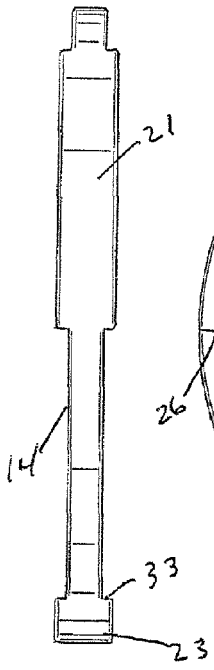
FIG. 4
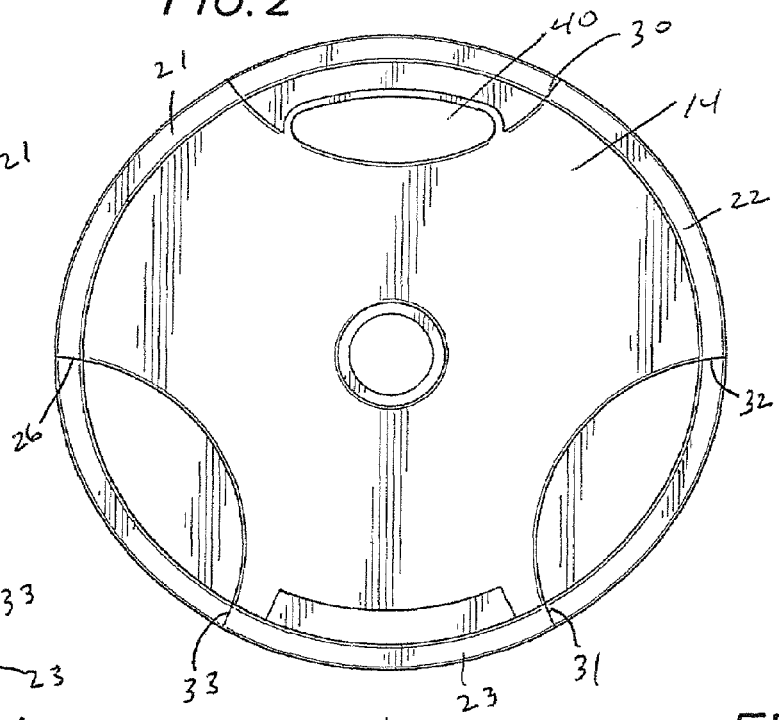
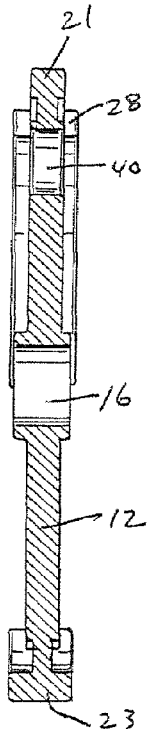
FIG. 5
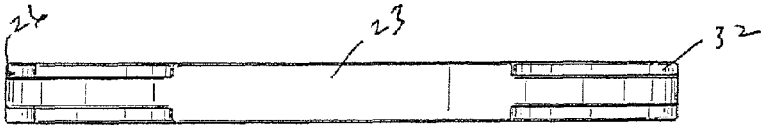
FIG. 6

WEIGHT PLATE

CROSS-REFERENCE TO RELATED APPLICATIONS

This is a continuation of application Ser. No. 11/422,650 filed 07 Jun. 2006, now U.S. Pat No. 7,300,389 which is incorporated herein by reference, to which priority is claimed, and which is a continuation of Ser. No. 10/862,294 filed 07 Jun. 2004, now abandoned, which is a continuation of application Ser. No. 09/758,770 filed 11 Jan. 2001, now U.S. Pat. No. 6,746,380.

BACKGROUND OF THE DISCLOSURE

The present invention relates generally to physical fitness equipment, particularly to weight plates which may be used during weight lifting.

The physical fitness industry has seen tremendous growth during the past couple of decades. A wide array of exercise apparatus is available to meet the needs of a growing population of consumers engaged in physical fitness activities. Some of the new exercise apparatus include high tech interactive features which can display sophisticated graphics and information for engaging and holding the attention of the user while he exercises. Little has changed however in the area of free weight exercises.

Free weight exercises generally require weight plates for use with barbells and dumbbells. The weight plates are typically disc-shaped and include a center opening for receiving a barbell or dumbbell bar through the opening. Generally, a retention collar mounted onto the barbell or dumbbell bar retains the weight plate on the bar. In some instances, particularly for dumbbells, the weight plates may be fixed to the weight bar.

One major problem with free weight lifting and a cause of many accidental injuries is that it is difficult to pick up a weight plate, particularly disc-shaped plates having flat sides. Most users can typically handle the lighter weights of 5 or 10 pounds without too much difficulty. But as the size and weight of the weight plate increases one must be very careful to avoid injury. The problem, simply stated, is that a flat sided weight plate does not have a convenient hand hold to be grasped by the user for lifting it off a flat surface, such as a floor or a stack of weight plates. Lifting a typical weight plate off of a flat surface requires that the user apply sufficient radial and frictional force on the periphery or outer perimeter of the disc-shaped plate to lift at least one side of the plate a sufficient distance off the flat surface to permit the user to place his fingers around the periphery and onto one of the flat surfaces of the plate. Of course, the heavier the weight plate, the more difficult the lifting maneuver becomes. Lifting a weight plate employing the generally accepted method described above can cause injury by slipping out of the grasp of the user and falling on toes or finger tips.

Some weight plates include a flat surface on one side and an upstanding circumferential flange about the periphery of the opposite or second flat side of the plate. This provides a raised surface which may be gripped for lifting the weight plate when it is lying on its flat side. The same problem is encountered, however, when an individual attempts to lift the weight by the circumferential flange. A sufficient radial and frictional force must still be applied to lift the plate on its peripheral edge so that the individual can grip the plate by wrapping his fingers and thumb about the upstanding flange and outer edge of the weight plate.

The problems noted above are not encountered solely when exercising with free weights. Many exercise apparatus require that weight plates be added or removed to vary the resistance provided by the exercise apparatus. The typical weight plate is not only difficult to lift off a flat surface as noted above, but also difficult to hold and raise it up, perhaps to chest level, to mount the weight plate on an exercise apparatus. Likewise, removing a weight plate from a relatively high position on an exercise apparatus is also difficult and if not done with care may result in injury to the individual removing the weight plate.

Another problem associated with weight plates having a circumferential upstanding flange on one or both sides of the weight plate, is that the weight plates mounted on the weight bar are not in facing contact. The weight plates typically contact each other only at the flanges and are free to rotate about the weight bar relative to each other.

It is therefore an object of the present invention to provide a weight plate which may be securely gripped and moved from one location to another without regard to its position relative to a flat support surface or the like.

It is another object of the present invention to provide a weight plate that includes at least one notch formed in a perimeter flange providing access for engaging a flat surface of the weight plate and applying an axial force to lift the weight plate off a flat support surface.

It is also an object of the present invention to provide a weight plate having at least one opening formed in the weight plate body near the circumferential edge thereof. The openings is sized to permit an individual's fingers to extend through the opening with the thumb wrapped around the edge of the weight plate for lifting the weight plate.

It is still another object of the present invention to provide a weight plate adapted for interlocking engagement with an adjacent weight plate mounted on a weight bar.

SUMMARY OF THE INVENTION

In accordance with the present invention, an improved weight plate is provided that is easily moved from a flat support surface. The weight plate includes a planar body having a central opening for receiving a barbell or dumbbell bar therethrough. Oppositely facing flange members extend partially about the perimeter of the weight plate. The opposed ends of the flange members are spaced from each other and define a gap therebetween. The flange members extend perpendicularly from both sides of the weight plate planar body about the perimeter thereof. The flange members project in opposite directions from the planar body of the weight plate a sufficient distance to permit at least one finger of an average human hand to extend through the gap separating the ends of the flange members for applying an axial force on the bottom planar surface of the weight plate. For example, FIG. 2 shows a weight plate having opening 40 and FIG. 8 shows the same weight plate have three openings, 40, 41, and 42.

The weight plate includes at least one grip opening formed adjacent the peripheral edge of the weight plate. The opening is adapted to receive one or more fingers of an average human hand for securely grasping and lifting the weight plate.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 2 is a plan view of the weight plate of the invention;

FIG. 3 is an edge view of the weight plate of the invention looking at the top of the weight plate shown in FIG. 2;

FIG. 4 is an edge view of the weight plate of the invention looking at the side of the weight plate shown in FIG. 2;

FIG. 5 is a section view of the weight plate of the invention taken along line 5-5 of FIG. 2;

FIG. 6 is an edge view of the weight plate of the invention looking at the bottom of the weight plate shown in FIG. 2;

DETAILED DESCRIPTION OF A PREFERRED EMBODIMENT

Figure 1:
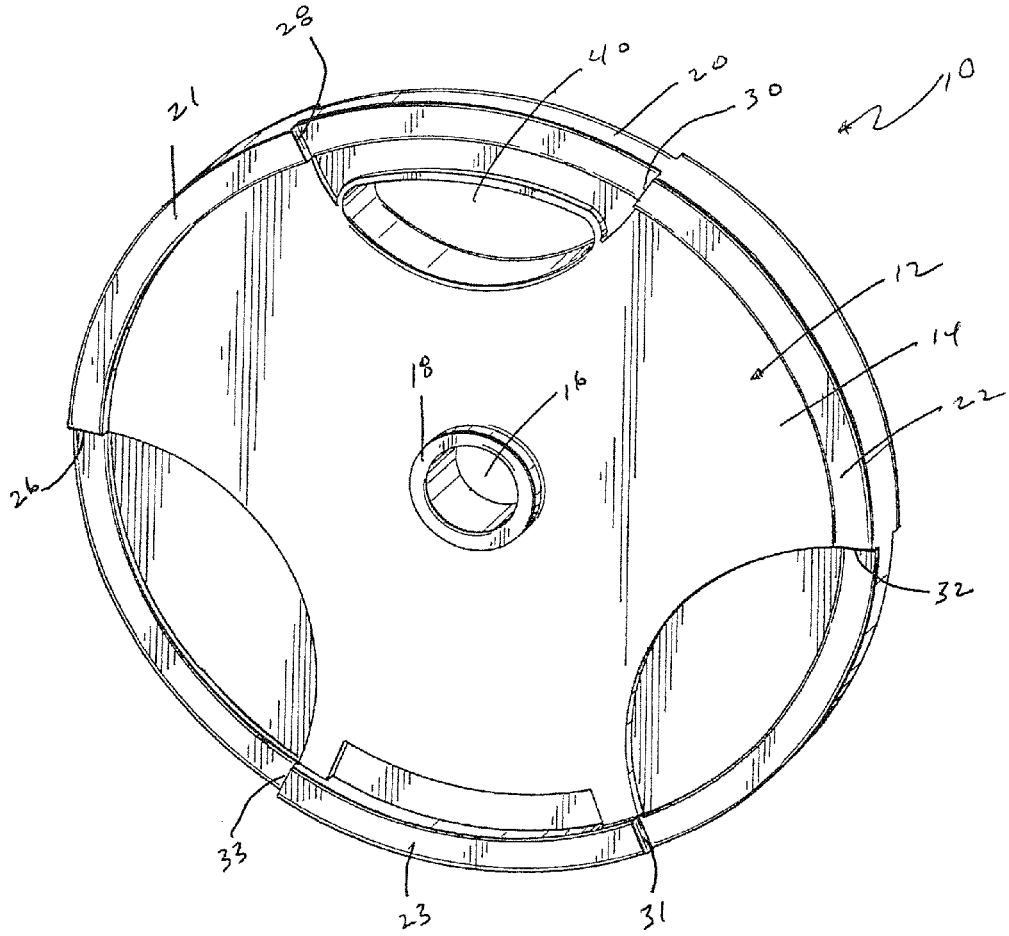
FIG. 1 is a perspective view of the weight plate of the invention.

Referring first to FIG. 1, the weight plate of the invention is generally identified by the reference numeral 10. The weight plate 10 may be cast, rubber coated and/or polyurethane coated. The weight plate 10 includes a substantially flat body 12 defined by first and second planar surfaces 14. The planar surfaces 14 are generally opposed and define the thickness of the plate 10. A centrally located bore 16 defines the rotational axis of the plate 10 and is adapted to receive a mounting member, such as a barbell or weight bar. The bore 16 is further defined by integrally formed collars 18 which circumscribe the bore 16 and project outwardly from the surfaces 14 of the weight plate body 12. The collars 18 are oriented perpendicular to the body surfaces 14 and add axial length to the bore 16. It is understood that the diameter of the bore 16 may vary to accommodate the diameter of a barbell or dumbbell bar to be received through the bore 16. The diameter of the bore 16 will generally vary between 1 to 2 inches to accommodate most standard barbell bars.

Referring still to FIG. 1, the opposed planar surfaces 14 of the plate body 12 terminate at a circular outer periphery of the plate body 12. The outer periphery of the plate body 12 is defined by a continuous end surface 20 which extends between the plate body surfaces 14, thereby defining the thickness of the plate body 12. The weight plate 10 further includes flange members 21, 22 and 23 integrally formed therewith and forming a portion of the outer periphery of the plate body 12. The flange members 21, 22 and 23 extend in opposite direction outwardly from the opposed planar surfaces 14 of the plate body 12. The flange member 21 extends partially about the plate body 12 beginning at a first end 26 and terminating at a second end 28. Likewise, the flange member 22 extends partially about the plate body 12 beginning at a first end 30 and terminating at a second end 32, and the flange member 23 likewise beginning at a first end 31 and terminating at a second end 33.

The flange members 21, 22 and 23 are spaced from each other defining gaps 36 therebetween. The gaps 36 are dimensioned so that one or more fingers of a human hand can be radially extended through the gaps 36 for engaging the bottom flat surface 14 of the weight plate 10.

In the preferred embodiment of the invention shown in FIG. 1, the weight plate body 12 includes an opening 40 formed in the weight plate 10. The opening 40 is disposed adjacent the peripheral edge of the weight plate body 12 between one or more of the gaps 36 defined between the flange members 21, 22 and 23.

The opening 40 is sized to accommodate one or more fingers of a human hand extending through the opening 40 and wrapped around the peripheral edge of the weight plate body 12. For example, the opening 40 in the weight plate 10 shown in FIG. 1 is sized to receive at least four fingers of a human hand extending therethrough. The opening 40 provides sufficient clearance so that the knuckles of the fingers do not hit or scrape against the inner surface 42 of the opening 40. Sharp edges are eliminated by rounding the edges of the openings 40. Likewise, the perimeter flange members 21, 22 and 23 are rounded to avoid scratching or gouging the floor or harming the user in the event the weight plate 10 is brushed against the user's body.

Figure 7:
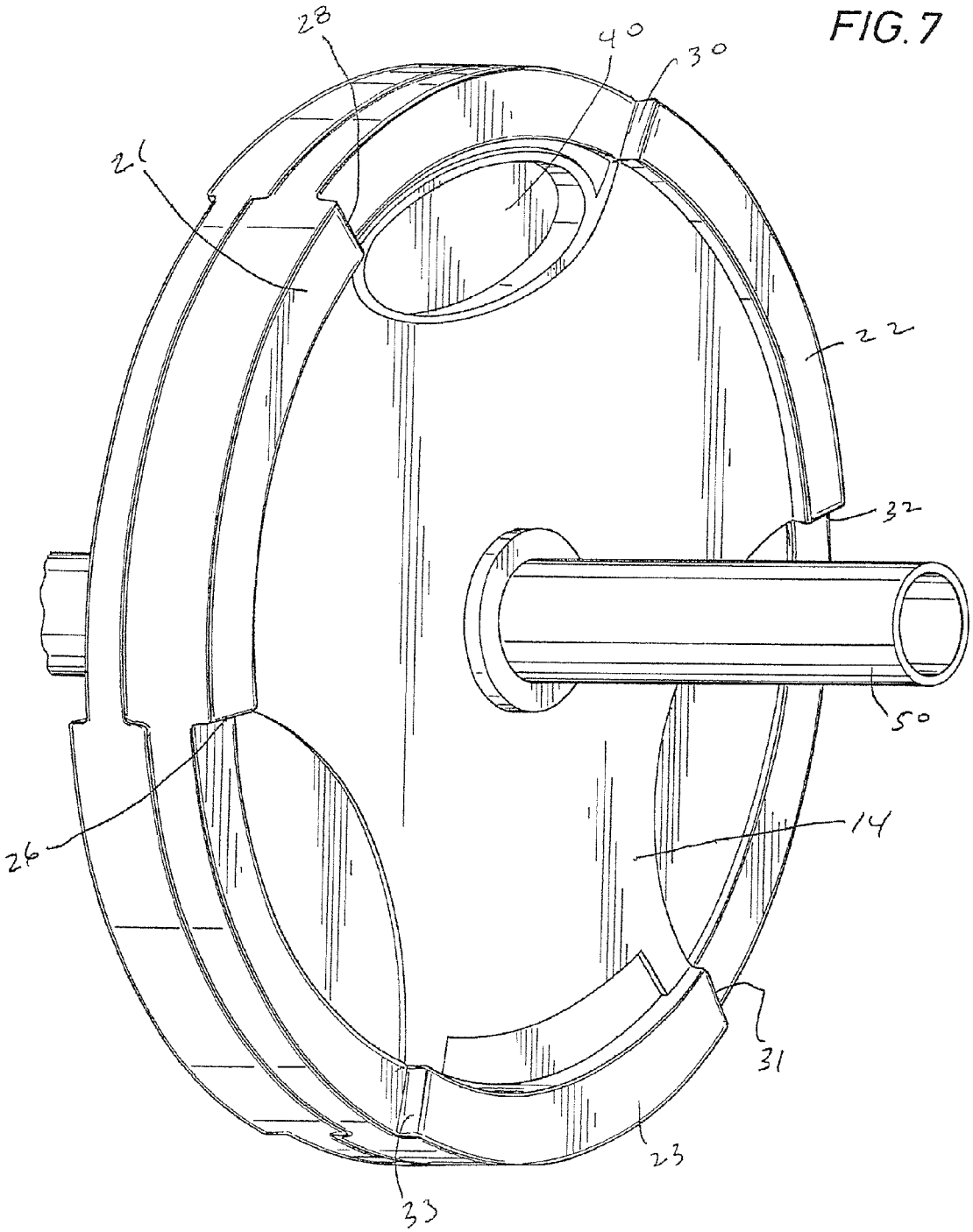
FIG. 7 is a perspective of weight plates of the invention mounted on a barbell bar in interlocking engagement.
Figure 8:
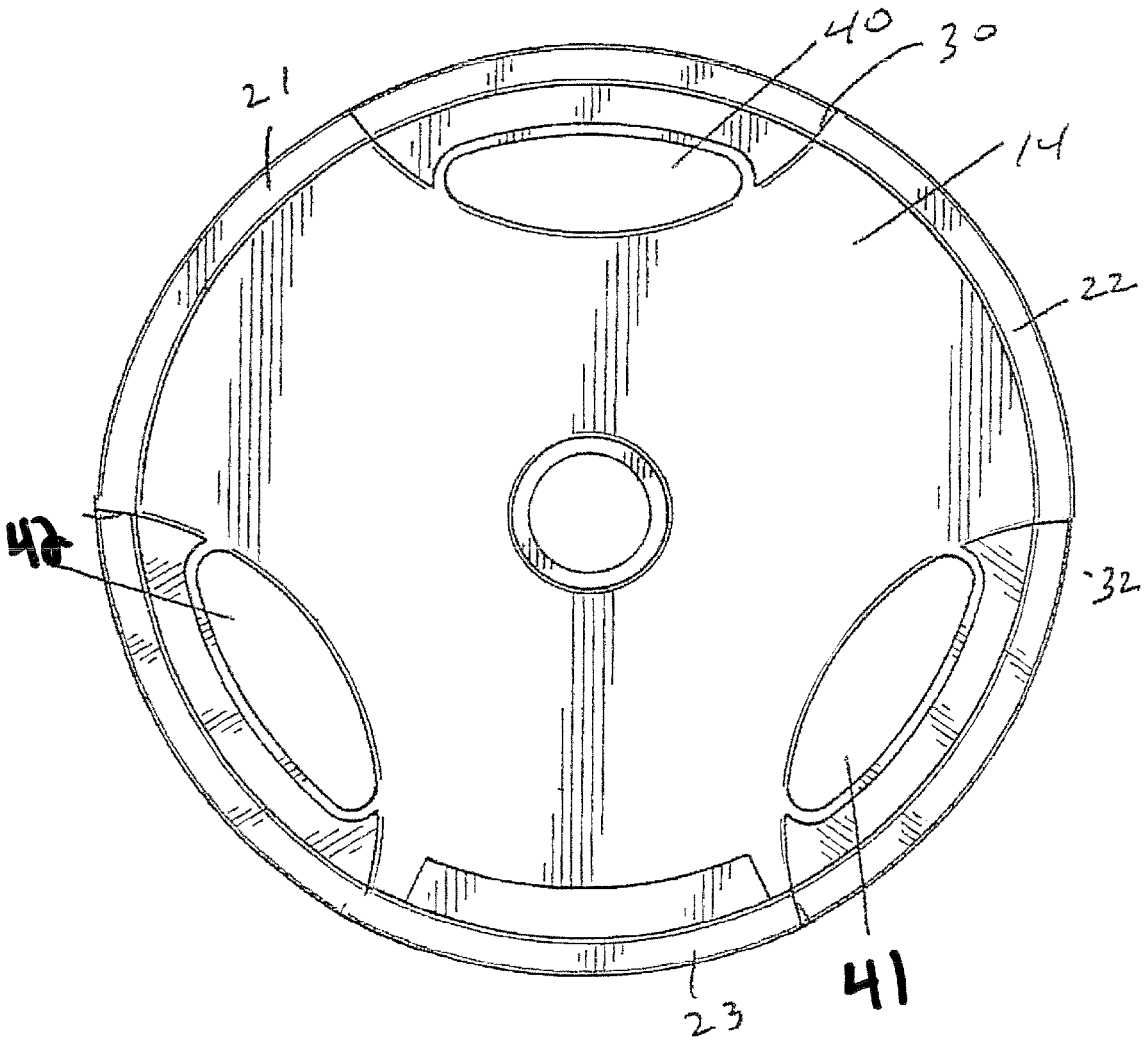
FIG. 8 is another plan view of the weight plate of the invention.

Referring now to FIG. 7, weight plates 10 of the invention are shown in interlocking engagement mounted on a weight bar 50. It will be observed that the depth of the gaps 36 is substantially equal to the height of the flange members 21, 22 and 23 extending above the planar surfaces 14 of the weight plate body 12. Additionally, the width of the gaps 36 is slightly greater than the width of the flange members 21, 22 and 23 so that they may extend into the gaps 36 when aligned therewith. In this manner, the weight plates 10 are mounted in interlocking facing contact on the weight bar 50. The weight plates 10 are thereby mounted on the weight bar 50 without play or relative rotation between adjacent weight plates 50.

The weight plate 10 of the present invention overcomes disadvantages associated with lifting known disc-shaped weights. When the weight plates 10 are on a flat surface or stacked on each other, the flange members 21, 22 and 23 support the weight plate body 12 above the support surface so that the user may extend his fingers through the opening 40 and wrap his thumb around the peripheral edge 20 of the weight plate 10. By holding the weight plate 10 in this fashion, a user may securely grip the weight plate 10 and lift it off the support surface and mount it on a barbell or dumbbell.

While a preferred embodiment of the invention has been shown and described, other and further embodiments of the invention may be devised without departing from the basic scope thereof, and the scope thereof is determined by the claims which follow.

What is claimed is:

1. A weight, comprising:

a body having an edge and opposite sides and defining a central bore therethrough; and at least two sets of projections disposed partially about the edge of the body, each of the projections of the at least two sets extending from one of the opposite sides of the body and having terminal ends spaced from each other, each of the terminal ends being engageable with a terminal end of another projection on an adjacent weight positioned adjacent the body and restricting relative rotation between the adjacent weight and the body.

2. The weight of claim 1, wherein the body has a collar formed about the central bore and extending from at least one of the opposite sides.

3. The weight of claim 1, wherein the body defines at least one opening therethrough adjacent the edge, and wherein the edge of the body defines at least one handle adjacent the at least one opening.

4. The weight of claim 3, wherein the body defines one portion being thinner than other portions of the body and being disposed adjacent the edge opposite the at least one opening.

5. The weight of claim 3, wherein the at least one handle is positioned at the edge between the terminal ends of the projections.

6. The weight of claim 1, wherein the at least two sets of projections are alternatingly disposed about the edge of the body.

7. The weight of claim 1, wherein the body defines at least two of the openings adjacent the edge, and wherein the edge defines at least two of the handles adjacent the at least two openings.

8. The weight of claim 7, wherein each of the at least two sets of projections are alternatingly disposed about the edge of the body, and wherein each of the at least two handles are disposed at the edge of the body between the at least two sets of projections.

9. The weight of claim 8, wherein each of the projections has a first perimeter dimension from terminal end to terminal end, and wherein each of the handles has a second perimeter dimension that is greater than the first perimeter dimension.

10. A weight, comprising:

a body having an edge and opposite sides, the body defining at least two openings adjacent the edge and a central bore therethrough, the edge defining at least two handles adjacent the at least two openings; and at least two sets of projections disposed partially about the edge of the body, each of the projections for each of the at least two sets extending from the opposite sides of the body and having terminal ends spaced from each other, each of the terminal ends being engageable with a terminal end of another projection on an adjacent weight positioned adjacent the body and restricting relative rotation between the adjacent weight and the body.

11. The weight of claim 10, wherein the at least two sets of projections are equally spaced about the edge of the body.

12. The weight of claim 11, wherein the at least two handles are alternatingly disposed about the edge between the at least two sets of projections.

13. The weight of claim 12, wherein each of the projections has a first perimeter dimension from terminal end to terminal end, and wherein each of the handles has a second perimeter dimension that is greater than the first perimeter dimension.

14. The weight of claim 13, wherein the weight comprises three of the at least two openings, three of the at least two handles, and three of the at least two sets of projections.

15. A weight, comprising:

a body having opposite sides and defining a central bore therethrough, the body having at least two edge portions and at least two open portions alternatingly disposed about a perimeter of the weight, at least two handles disposed across the at least two open portions and interconnecting the at least two edge portions, and at least two sets of projections, each of the at least two sets disposed at one of the at least two edge portions, each of the projections extending from the opposite sides of the body and having terminal ends spaced from each other, each of the terminal ends being engageable with a terminal end of another projection on an adjacent weight positioned adjacent the body and restricting relative rotation between the adjacent weight and the body.

16. The weight of claim 15, wherein the weight comprises three of the at least two edge portion, three of the at least two open portions, three of the at least two handles, and three of the at least two sets of projections.

17. The weight of claim 15, wherein the at least two edge portions are equally spaced about the perimeter of the weight.

18. The weight of claim 15, wherein each of the edge portions has a first perimeter dimension about the perimeter of the weight, and wherein each of the open portions has a second perimeter dimension about the perimeter that is greater than the first perimeter dimension.

19. The weigh of claim 18, wherein each of the projections has a third perimeter dimension from terminal end to terminal end that is equal to the first perimeter dimension.

20. A weight, comprising:

a body having an edge and opposite sides and defining a central bore therethrough; and at least two projections disposed partially about the edge of the body, each of the projections extending from one of the opposite sides of the body and having terminal ends spaced from each other, each of the terminal ends being engageable with a terminal end of another projection on an adjacent weight positioned adjacent the body and restricting relative rotation between the adjacent weight and the body, wherein the body defines at least one opening therethrough adjacent the edge, wherein the edge of the body defines at least one handle adjacent the at least one opening, and wherein the body defines one portion being thinner than other portions of the body and being disposed adjacent the edge opposite the at least one opening.

21. The weight of claim 20, wherein the body has a collar formed about the central bore and extending from at least one of the opposite sides.

22. The weight of claim 20, wherein the at least one handle is positioned at the edge between the terminal ends of the projections.

23. The weight of claim 20, further comprising at least two sets of the projections disposed partially about the edge of the body, each of the projections of the at least two sets extending from the opposite sides of the body and having terminal ends spaced from each other.

24. The weight of claim 23, wherein the at least two sets of projections are alternatingly disposed about the edge of the body.

25. The weight of claim 23, wherein the body defines at least two of the openings adjacent the edge, and wherein the edge defines at least two of the handles adjacent the at least two openings.

26. The weight of claim 25, wherein each of the at least two sets of projections are alternatingly disposed about the edge of the body, and wherein each of the at least two handles are disposed at the edge of the body between the at least two sets of projections.

27. The weight of claim 26, wherein each of the projections has a first perimeter dimension from terminal end to terminal end, and wherein each of the handles has a second perimeter dimension that is greater than the first perimeter dimension.

* * * * *